US007086902B1

(12) United States Patent
Yang

(10) Patent No.: US 7,086,902 B1
(45) Date of Patent: Aug. 8, 2006

(54) CONNECTOR WITH IMPROVED SHIELDING MEMBER

(75) Inventor: Meng-Huan Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/300,946

(22) Filed: Dec. 15, 2005

(51) Int. Cl.
*H01R 13/648* (2006.01)

(52) U.S. Cl. ..... 439/607; 439/876

(58) Field of Classification Search ..... 439/607–609, 439/70, 680, 83, 876
See application file for complete search history.

(56) References Cited

U.S. PATENT DOCUMENTS 6,939,172 B1 * 9/2005 Lu ..... 439/607
2002/0064998 A1 * 5/2002 Handa et al. ..... 439/607
2005/0042924 A1 * 2/2005 Zhang et al. ..... 439/607
2005/0215117 A1 * 9/2005 Asai et al. ..... 439/607
2005/0215118 A1 * 9/2005 Asai et al. ..... 439/607

* cited by examiner

*Primary Examiner*—Hien Vu
(74) *Attorney, Agent, or Firm*—Wei Te Chung

(57) ABSTRACT

An electrical connector (100) adapted for electrically connecting an electronic element (1) such as a camera module with a substrate (200) comprises a shielding member (2, 3), an insulated housing (5) and a number of contacts (4) retained in the housing. Each contact comprises a contact portion (41) for electrically contacting with the camera module and a solder portion (44) extending out the housing for being soldered on the substrate. The shielding member surrounds the housing to prevent the contact from unexpected Electro Magnetic Interference and comprises a plurality solder legs soldered on the substrate. The solder legs are arranged among the solder portions of the contacts. Typically, the distance between every two adjacent solder legs is not greater than 2.5 millimeters. Therefore, the shielding member can effectively prevents various unexpected interference affecting signal transmission of the camera module.

9 Claims, 7 Drawing Sheets

CONNECTOR WITH IMPROVED SHIELDING MEMBER

BACKGROUND OF THE INVENTION

1. Field of the Invention

The present invention relates to an electrical connector, and more particularly to an electrical connector for mounting a camera module on a substrate such as a printed circuit board, a printed wiring board and the like.

2. Description of Related Art

Due to the development of the information and communication technology industry, various types of portable wireless terminals such as mobile phones, Personal Digital Assistant always simply called as PDA and so forth. Said terminals are provided with various functions, for example, e-mail reception and transmission, Internet games and text transmission. Beyond the above basic functions, recently, image communication as a new function is introduced. As a result, said various portable wireless terminals are additionally provided with camera modules, correspondingly, electrical connectors are used for connecting with the camera modules are also provided.

U.S. Patent Publication No. 20030218873 discloses an electrical connector adapted for connecting with a camera module. The electrical connector comprises an insulated housing provided with a plurality of contact channels, a plurality of contacts respectively retained in the contact channels and a shielding member protecting the camera module. The housing is substantially rectangular in shape. Said contact channels are arranged in two rows and extend though the upper and lower surfaces of the housing. The contacts are divided into two groups, and respectively sideward mounted. Each contact has a retentive portion fixed in the contact channel, a contact portion extending upward from the retentive portion and through the upper surface of the housing and a solder portion extending downward from the retentive portion. The shielding member has a first, second, third and fourth vertical shielding portions extending vertically, a bottom shielding portion connecting the first and third side shielding portions and a receiving cavity surrounded by said shielding portions. Each vertical shielding portion has some resilient tabs extending upward for firmly retaining the camera module in the receiving cavity. The first vertical shielding portion symmetrically defines two square holes, and the third vertical shielding portion opposite to the first vertical shielding portion defines a square hole. Said square holes respectively are used for blocking the projections defined by the camera module so that the camera module hardly breaks off the shielding member. However, the solder portions of the contacts extend through the bottom shielding portion of the shielding member to expose out for being soldered on a substrate induce that the solder portions are easily affected by Electro-Magnetic waves produced by other electronic elements. Further, with the tendency toward miniaturizing and lightening portable wireless terminals, it is difficult to secure much space for mounting the camera module. Thus, the distance of the contacts of the electrical connector for accommodating the camera module become smaller and smaller, thus inducing that the contacts also easily suffer from cross-talk interference.

Additionally, in some applications, the electrical connector is required to be mounted on a substrate in sink type in order to make the portable wireless terminal on which the electrical connector is mounted low profile. In this way, the contacts of this connector generally extend sideward beyond the housing and the shielding member to be soldered on the substrate in surface mounted technology. Thus, the contacts are easier to be affected by the electromagnetic interference than that disclosed in US. Patent Publication No. 20030218873.

Therefore, a new connector is desired to overcome the disadvantages of the prior arts.

SUMMARY OF THE INVENTION

An object of the present invention is to provide an electrical connector with a shielding member which can effectively protect the electrical connector from Electro-Magnetic Interference.

In order to achieve above-mentioned object, an electrical connector adapted for electrically connecting an electronic element such as a camera module with a substrate in accordance with a preferred embodiment of the present invention is provided. The electrical connector comprises a shielding member, an insulated housing and a plurality of contacts retained in the housing. Each contact comprises a contact portion for electrically contacting with the camera module and a solder portion extending out the housing for being soldered on the substrate. The shielding member surrounds the housing to prevent the contact from unexpected Electro Magnetic Interference and comprises a plurality solder legs extending among the solder portion of the contacts for being soldered on the substrate. Typically, the distance between every two adjacent solder legs is not greater than 2.5 millimeters.

Other objects, advantages and novel features of the present invention will become more apparent from the following detailed description of the present embodiment when taken in conjunction with the accompanying drawings.

DETAILED DESCRIPTION OF THE INVENTION

Figure 1:
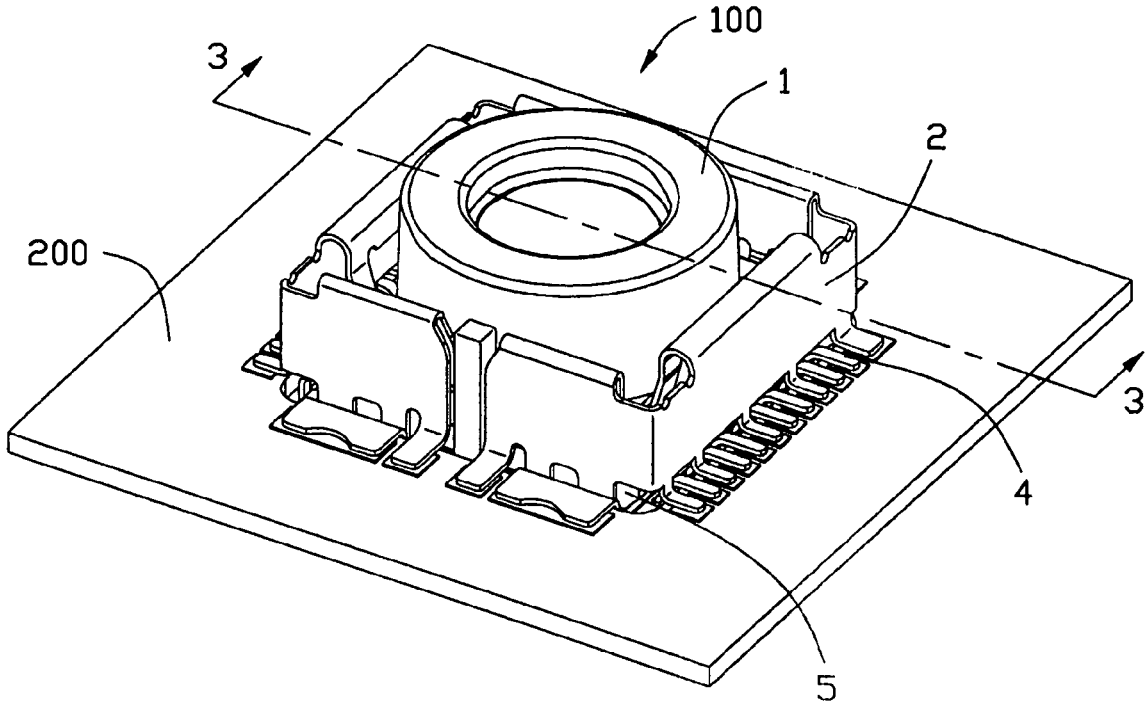
FIG. 1 is a top, assembled, perspective view of an electrical connector in accordance with the present invention.

Reference will now be made to the drawing figures to describe the preferred embodiment of the present invention in detail.

Figure 2:
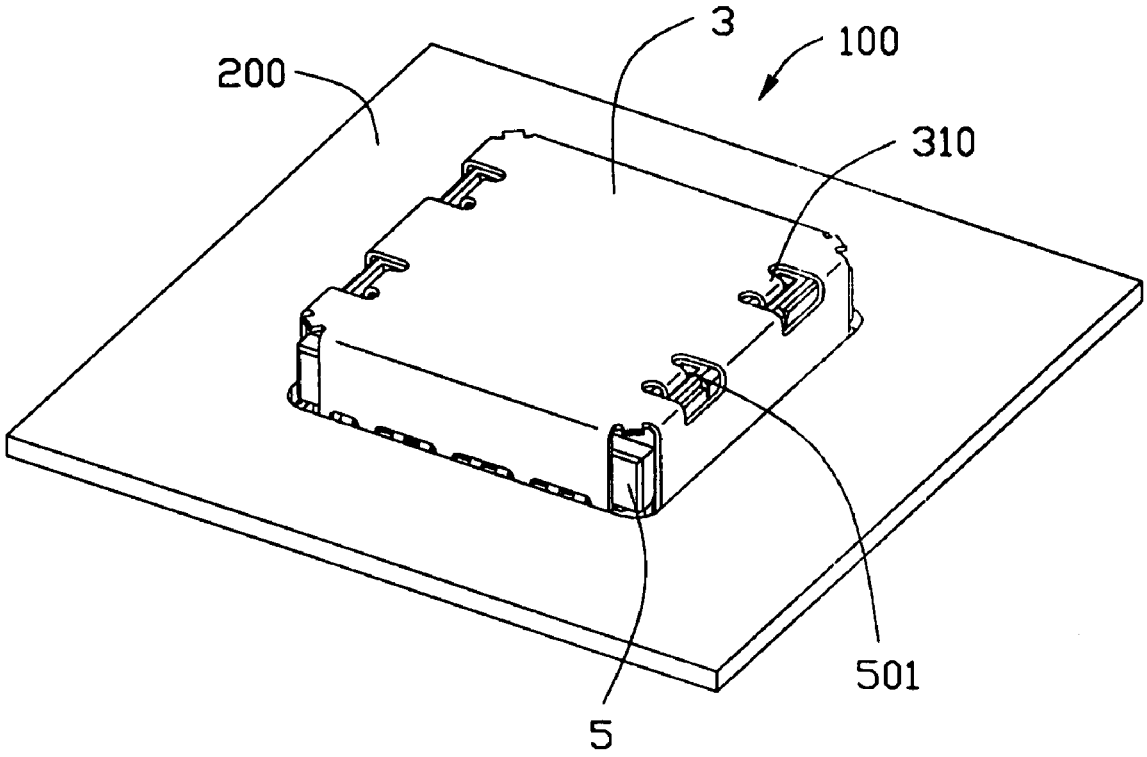
FIG. 2 is a similar view of FIG. 1, but taken from a bottom view.
Figure 3:
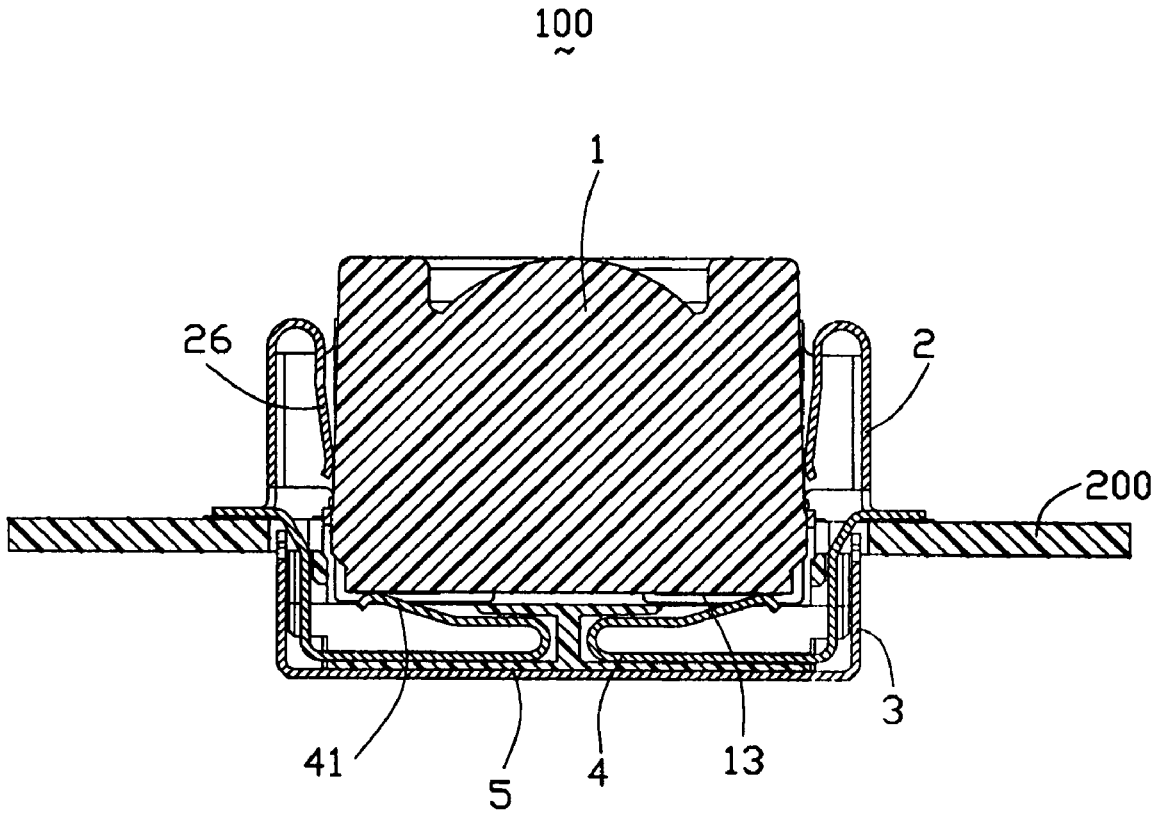
FIG. 3 is a cross-sectional view of FIG. 1 taken along line 3—3.

Referring to FIGS. 1, 2 and 3, an electrical connector 100 for connecting an electronic element with a printed circuit board (PCB) 200. In this embodiment, the electronic element is a camera module 1. The electrical connector 100 comprises a shielding member, an insulated housing 5 and a plurality of electrical contacts 5 retained in the housing 5.

Figure 4:
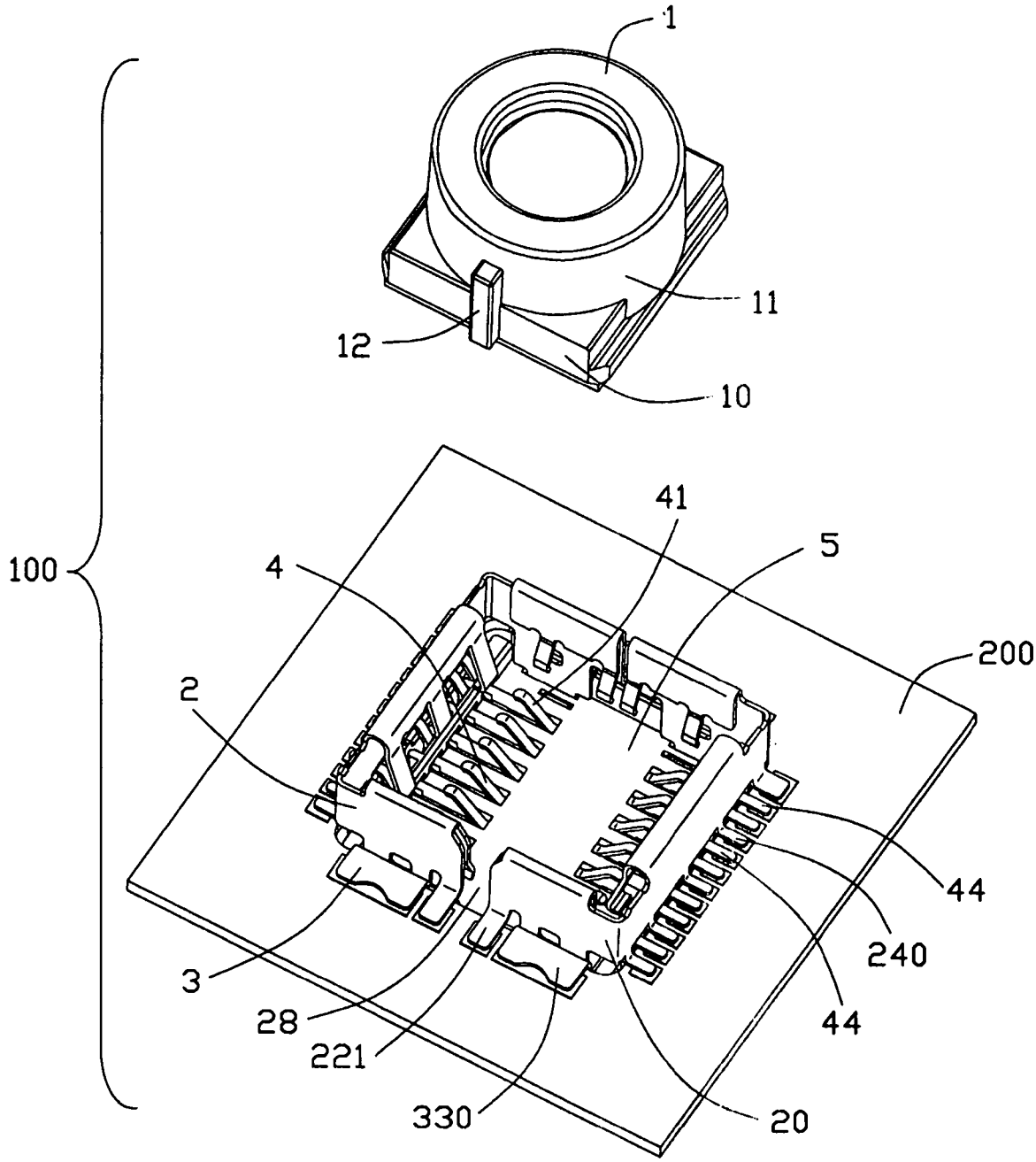
FIG. 4 is a partially assembled, perspective view of FIG. 1.
Figure 6:
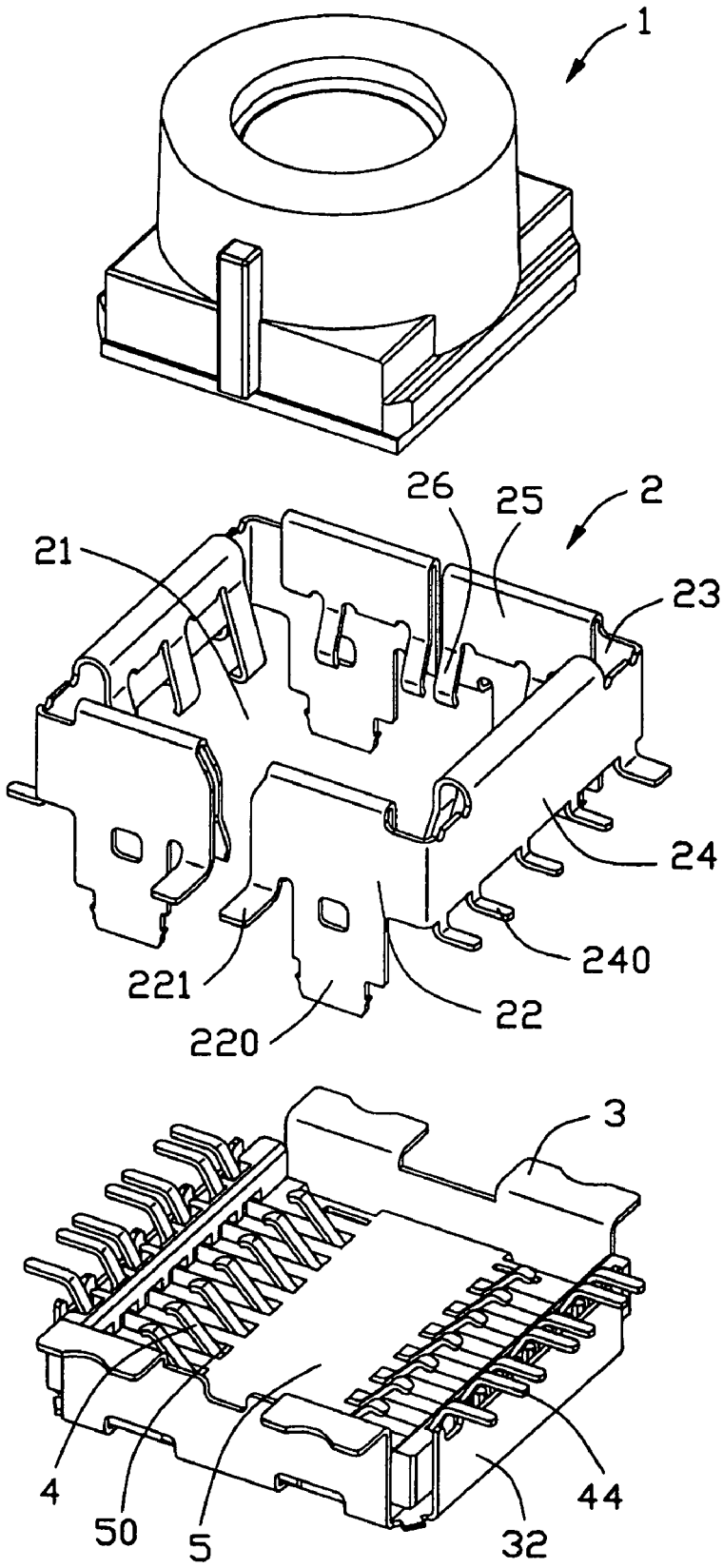
FIG. 6 is a partially assembled, perspective view of the electrical connector, intending to show the relationship between the housing and a lower shell.

Referring to FIGS. 4 and 6, the shielding member consists of an upper shell 2 and a lower shell 3. The upper shell 2 consists of a pair of metal frame 20 which are symmetrically and separately arranged to surround a receiving cavity 21. The two metal frame 20 have same configuration ad each has three vertical walls that are a front wall 22, a rear wall 23 opposite and parallel to the front wall 22 and a side wall 24 jointing the front wall 22 with the rear wall 23. Each vertical wall comprises a fold portion 25 extending downward from a top edge thereof and toward the receiving cavity 21. A plurality of resilient tabs 26 continually extend from bottom edges of the fold portions 25 into the receiving cavity 21 and are arranged equally so as to provide stable force for retaining the camera module 1. The front wall 22 and the rear wall 23 respectively comprises a solder leg 221 extending outward and horizontally along an upper surface of the PCB 200 and a projecting tab 220 extending downward and defining some barbs (not labeled) for interferentially engaging with the housing 5 (shown clearly in FIG. 7) at both sides thereof. The side wall 24 also has a plurality of solder legs 240 extending outward horizontally along an upper surface of the PCB 200. It is noted that the solder legs 221, 240 all extends away from the receiving cavity 21 and finally are soldered on the upper surface of the PCB 200 in surface mounted technology. Typically, the distances between every two adjacent solder legs 240 are not greater than 2.5 millimeters. Additionally, there is a clearance 28 formed between the front walls 22 of the two metal frames 20 for accommodating a partial portion of a positioning rib 12 formed on the camera module 1.

Figure 7:
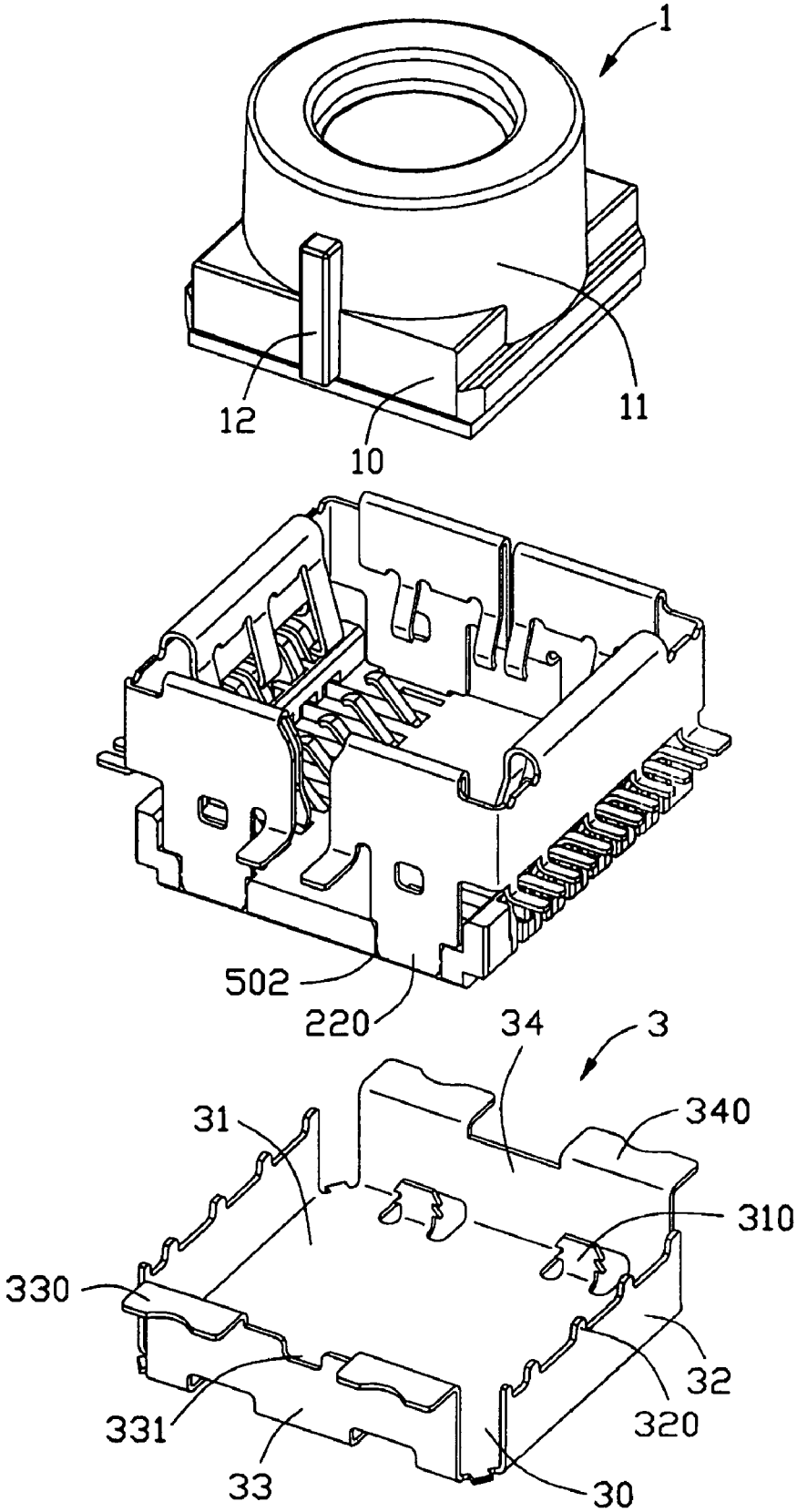
FIG. 7 is a similar view of FIG. 6, but intending to show the relationship between the housing and an upper shell.

Referring to FIGS. 2, 6 and 7, the lower shell 3 has a receiving cavity 30 surrounded by a flat bottom wall 31 and four vertical walls extending upward from the bottom wall 31. Said four vertical walls are a front wall 33, a rear wall 34 and a pair of side walls 32, and there is a clearance left between arbitrary two vertical walls for giving the lower shell 3 more resilience. The bottom wall 31 defines four retentive tabs 310 for interferentially retaining in corresponding retentive grooves 501 defined by the housing 5, and two located in a joint portion adjacent to the front wall 33 while the other two located in a joint portion adjacent to the rear wall 34. The front wall 33 and the rear wall 34 respectively have a pair of connection legs 330, 340 extending along a same direction of the solder legs 221 of the upper shell 2 for connecting to the upper surface of the PCB 200. A cutout 331 is recessed downward at a middle portion of the front wall 33. The cutout 331 is paired with the clearance 28 to cooperatively receive the positioning rib 12 of the camera module 1. Said two side walls 32 have same structure, and each comprises a plurality of protrusions 320 projecting upward from a top edge thereof and accordingly a plurality of recesses (not labeled) formed between the protrusions 320 for aligning with solder portions 44 of contacts 4. It is noted that said receiving cavities 21, 30 of the upper shell 2 and the lower shell 3 are paired together to form a receiving space for cooperatively retaining the housing 5 and the camera module 1 therein.

Figure 5:
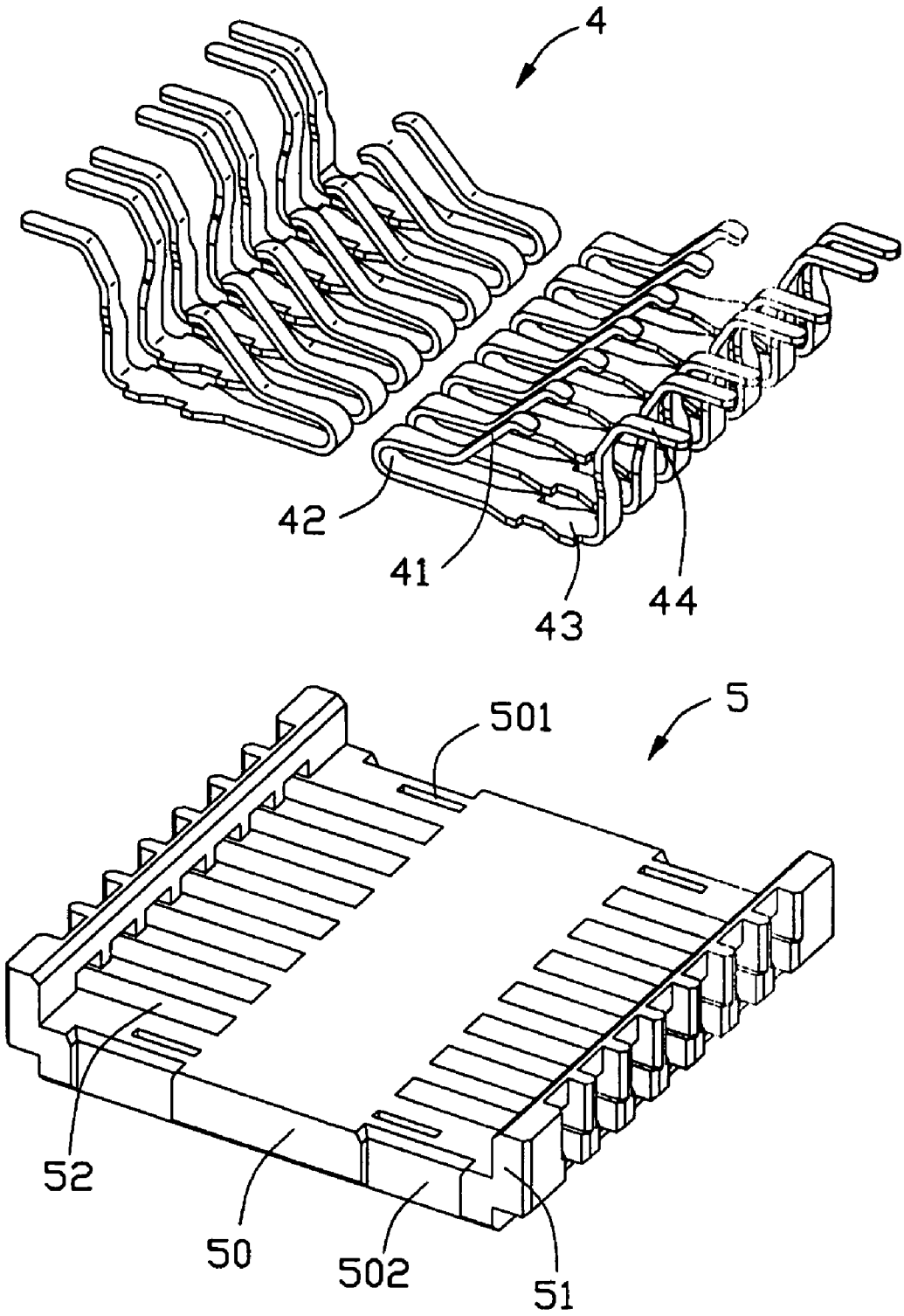
FIG. 5 is a perspective view of a housing and a plurality of contacts of the electrical connector.

Referring to FIGS. 4, 5 and 6, the housing 5 comprises a main portion 50 and a pair of longitudinal walls 51 extending upward from the main portion 50 and opposite to each other. A plurality of contact channels 52 are arranged into two groups and respectively extend from longitudinal portions of the housing 5, and further extend upward though the longitudinal walls 51. The electrical contacts 4 each comprises a retentive portion 43 for fixing the contact 4 in the contact channel 52, a bended portion 42 extending from the retentive portion 43 for providing more elasticity, a contact portion 41 extending beyond an upper surface of the housing 5 for electrically connecting with the camera module 1 and a solder portion 44 extending from the retentive portion 43 away from the bended portion 42. Further, the solder portions 44 all extend out the longitudinal walls 51 and are coplanar with the solder legs 240 of the upper shell 2. The adjacent solder portions 44 bias in a reversed direction. Especially, the solder portions 44 are located higher than the contact portions 41, thus the connector 100 can be mounted on the PCB 200 in sink type.

Referring to FIGS. 3 and 4, the camera module 1 comprises a base portion 10 with a rectangular shape and a columnar portion 11 extending upward from the base portion 10. Said positioning rib 12 projects from the front surface of the base portion 10 and the columnar portion 11 for preventing the camera module 1 from being mounted mistakenly. The camera module 1 further has a plurality of solder pads 13 disposed at a bottom surface of the base portion 10 for electrically contacting with corresponding contact portions 44 of the contacts 4.

The structures of every parts of the electrical connector 100 have been explained clearly in the above description., and the relationships between the parts will be shown as follows.

Referring to FIG. 5, the electrical contacts 4 are firstly mounted in corresponding contact channels 52 of the housing 5, when the contact portions 41 are exposed above the main portion 50 and the solder portions 44 all extend out the longitudinal walls 51. Referring to FIGS. 2, 6 and 7, the housing 5 with the contacts 4 therein is mounted into the receiving cavity 30 of the lower shell 3. The firm installation between the housing 5 and the lower shell 3 is achieved via the tightly engagement of the four retentive tabs 310 and the retentive grooves 501. The solder portions 44 of the contacts 4 stride over the top edge of the side walls 32 and extend out of the receiving cavity 30. Then the upper shell 2 is mounted on the housing 5 via the projecting tabs 220 being fixed in the corresponding opening 502 defined by the housing 5 and sandwiched by the housing 5 and the front wall 33 or the rear wall 34. In this way, the contacts 4 are almost enclosed by the upper and lower shells 2, 3, so the contacts 4 are hardly affected by the Electro-Magnetic Interference. The solder legs 240 of the upper shell 2 are respectively interposed between the solder portions 240. In this embodiment, between every two adjacent solder legs 240 is arranged two solder portions 44 of the contacts, of course, according to various requirement or other reasons, the solder legs 240 and the solder portions 44 can be arranged alternatively. Likewise, the solder legs 240 can also be part of the lower shell 3. As long as the distances between every two adjacent solder legs 240 are not greater than 2.5 millimeters, Electro-Magnetic Interference or cross talk or other interferences cannot affect the signal transmission of the contacts 4.

Further, the camera module 1 is mounted from the upper shell 2. Because of the upper shell 2 formed by two separated metal frames 20, it has adequate elasticity to deform even if the size of the camera module 1 is unexpected enlarged. During the process of mounting, the resilient tabs 26 formed on the metal frames 20 are urged deform to leave enough space for the camera module 1 extending through. When the camera module 1 is completely mounted, the lower portion of the camera module 1 is retained in the receiving cavity 30 of the lower shell 3, and the other portions are retained in the receiving cavity 21 of the upper shell 2. Simultaneously, the full and stable contact between the solder pads 13 and the contact portion 41 is achieved.

Referring to FIG. 4, the complete assembled connector 100 is finally mounted on the PCB 200 in sink type via the connection legs 330, 340 of the lower shell 3, solder legs 221, 240 of the upper shell 2 and solder portions 44 of the contacts 4 being soldered on the PCB 200. There are many advantages for adopting the above-mentioned mounting type, for example, the connector 100 occupies little space in the height direction and thereby makes an electronic device (not shown) on which the connector 100 is mounted lower profile; The connector 100 can receive various camera module with various height only if the dimensions of the upper shell 2, the lower shell 3 and the contacts 4 are simply amended. The connection legs 330, 340 of the lower shell 3 and solder legs 221, 240 of the upper shell 2 are not only mounted on the PCB 200 but also electrical connect with the grounding lines (not shown) defined by the PCB 200, so the electric charges are easily released so as to obtain the more good function of protecting the camera module 1 and the contacts 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for connecting an electronic element to a substrate, comprising:

an insulated housing having retentive grooves in a main portion;

a plurality of contacts retained in the housing, each contact having a contact portion for electrically contacting with the electronic element and a solder portion for connecting with the substrate;

a shielding member enclosing the housing and having a plurality of solder legs for connecting with the substrate; and wherein the solder legs are located among the solder portions of the contacts, and the distance between every two adjacent solder legs is not greater than 2.5 millimeters;

wherein the shielding member comprises an upper shell and a lower shell which cooperatively form a receiving space, and wherein the housing is retained in a lower portion of the receiving space while other portions are used for retaining the electronic element;

wherein the upper shell and the lower shell respectively have a receiving cavity, and said receiving space is formed by pairing the two receiving cavities;

wherein said receiving cavity of the lower shell is surrounded by a bottom wall and four vertical walls which are a front wall, a rear wall and a pair of sidewalls;

wherein the bottom wall defines retentive tabs extending upwardly therefrom at joint portions adjacent to the front wall and the rear wall for retaining in the grooves of the housing;

wherein every two solder portions of the contacts adjacent to the solder legs of the shielding member bias away from each other.

2. The electrical connector as described in claim 1, wherein said solder legs extend from the upper shell.

3. The electrical connector as described in claim 1, wherein the upper shell consist of a pair of metal frame with a symmetrical structure which surround to form said receiving cavity, and each metal frame has a front wall, a rear wall and a side wall joining the front wall with the rear wall.

4. The electrical connector as described in claim 3, wherein each metal frame has a plurality of resilient tabs extending in the receiving cavity.

5. The electrical connector as described in claim 4, wherein there is a clearance formed between the front walls of the metal frames for confining a positioning rib defined by the electronic element.

6. The electrical connector as described in claim 3, wherein the solder legs extend from bottom edges of side walls of the upper shell away from the receiving cavity.

7. The electrical connector as described in claim 1, wherein the solder portions of the contacts are located higher than the contact portions.

8. An electrical connector comprising:

an insulated housing having retentive grooves in a main portion;

a plurality of contacts retained in the housing, each contact having a contact portion for electrically contacting with the electronic element and a solder portion for connecting with the substrate;

a shielding member enclosing the housing and having a plurality of solder legs for connecting with the substrate; and wherein the solder legs are located among the solder portions of the contacts, wherein for most of said solder legs, there are two of said solder portions are located between every adjacent two solder legs;

wherein said shielding member includes an upper shell and a lower shell;

wherein a receiving cavity of the lower shell is surrounded by a bottom wall and four vertical walls which are a front wall, a rear wall and a pair of sidewalls;

wherein the bottom wall defines retentive tabs extending upwardly therefrom at joint portions adjacent to the front wall and the rear wall for retaining in the grooves of the main portion of the housing.

9. The electrical connector as claimed in claim 8, wherein the solder legs are provided by both said upper and lower shells.

* * * * *